US010425713B2

(12) United States Patent
Pfaffinger

(10) Patent No.: US 10,425,713 B2
(45) Date of Patent: Sep. 24, 2019

(54) HEADPHONE ARRANGEMENT

(71) Applicant: Harman Becker Automotive Systems GmbH, Karlsbad (DE)

(72) Inventor: Gerhard Pfaffinger, Regensburg (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 16/062,000

(22) PCT Filed: Nov. 18, 2016

(86) PCT No.: PCT/EP2016/078208
§ 371 (c)(1),
(2) Date: Jun. 13, 2018

(87) PCT Pub. No.: WO2017/102253
PCT Pub. Date: Jun. 22, 2017

(65) Prior Publication Data

US 2018/0376231 A1 Dec. 27, 2018

Related U.S. Application Data

(60) Provisional application No. 62/267,068, filed on Dec. 14, 2015.

(51) Int. Cl.

| | |
|---|---|
| ***H04R 1/00*** | (2006.01) |
| ***H04R 1/10*** | (2006.01) |
| ***H04R 1/28*** | (2006.01) |
| *H04R 1/26* | (2006.01) |
| *H04R 3/00* | (2006.01) |
| *H04R 5/033* | (2006.01) |

(52) U.S. Cl.
CPC ..... *H04R 1/1008* (2013.01); *H04R 1/1066* (2013.01); *H04R 1/1091* (2013.01); *H04R 1/2811* (2013.01); *H04R 1/1075* (2013.01); *H04R 1/1083* (2013.01); *H04R 1/26* (2013.01); *H04R 3/005* (2013.01); *H04R 5/0335* (2013.01)

(58) Field of Classification Search
CPC .... H04R 5/033; H04R 1/1008; H04R 1/1016; H04R 1/105; H04R 1/1075; H04R 1/26
See application file for complete search history.

(56) References Cited

U.S. PATENT DOCUMENTS

2004/0032964 A1* 2/2004 Liang ..... H04R 5/0335 381/370
2008/0112581 A1* 5/2008 Kim ..... H04R 1/1075 381/151

(Continued)

FOREIGN PATENT DOCUMENTS

CN 102027760 A 4/2011
CN 103081510 A 5/2013

(Continued)

*Primary Examiner* — Matthew A Eason
(74) *Attorney, Agent, or Firm* — Brooks Kushman P.C.

(57) ABSTRACT

An example headphone arrangement includes at least one earphone. The at least one earphone includes a sealed housing having an aperture and a tube with a longitudinal axis. The tube is curved along its longitudinal axis to form a closed or open ring configured to totally or partly surround an ear of a user. A speaker is mounted to the housing at the aperture so that the housing in connection with the speaker encloses a closed acoustic volume.

24 Claims, 3 Drawing Sheets

(56) References Cited

U.S. PATENT DOCUMENTS

| | | | | |
|---|---|---|---|---|
| 2009/0175473 | A1 | 7/2009 | Wong et al. | |
| 2009/0285434 | A1 | 11/2009 | Williams et al. | |
| 2013/0216074 | A1* | 8/2013 | Kon | H04R 5/02 381/310 |
| 2015/0146880 | A1* | 5/2015 | Boni | H04R 1/1008 381/74 |
| 2017/0318372 | A1* | 11/2017 | Gerber | H04R 1/1008 |
| 2018/0192228 | A1* | 7/2018 | Woelfl | H04R 5/033 |

FOREIGN PATENT DOCUMENTS

| | | | |
|---|---|---|---|
| CN | 103155594 | A | 6/2013 |
| CN | 202980668 | U | 6/2013 |
| CN | 103945297 | A | 7/2014 |
| CN | 203722805 | U | 7/2014 |
| CN | 104581475 | A | 4/2015 |
| CN | 104620600 | A | 5/2015 |
| CN | 204539405 | U | 8/2015 |
| EP | 2611210 | A1 | 7/2013 |

* cited by examiner

HEADPHONE ARRANGEMENT

CROSS-REFERENCE TO RELATED APPLICATION

This application is the U.S. national phase of PCT Application No. PCT/EP2016/078208 filed on Nov. 18, 2016, which claims the benefit of U.S. Provisional Application No. 62/267,068 filed on Dec. 14, 2015, the disclosures of which are incorporated in their entirety by reference herein.

BACKGROUND

1. Technical Field

The disclosure relates to a headphone arrangement for reproducing audio, the headphone arrangement including at least one earphone.

2. Related Art

There are various techniques for delivering real audio, as well as electronically produced audio, to a user's ears allowing for the real sound environment (ambient sound) to remain audible and accessible when the electronically produced audio is played back. To this end, use is commonly made of closed earphones which occlude the ear canal. Reliance is then placed on the use of microphones and speakers for detecting real sound sources and transmitting the real sound sources to the user's ears. A drawback of this arrangement is that the user suffers from an occlusion effect that makes sounds generated in the user's body appear louder. A further disadvantage of this arrangement is that there will be leakage of the external sound through the earphones and a delay between the detection of the sound by the microphone and the playback via the speaker. The combination of the leakage component and the delayed playback component results in an addition of the sound produced by the real source with a delayed version of itself which, in turn, results in audible distortion.

Examples of such closed earphones include circumaural headphones, which fit around a user's outer ear, or ear-buds that fit within the ear. These items are referred to as "closed earphones" as they significantly occlude the sound path to the ear and substantially distort the external sound input to the ear. As indicated above, these types of earphones can significantly reduce the quality of an external sound that is heard by the user. Yet other techniques include "open" earphones which provide a low acoustic impedance seal around the outer ear thereby producing less occlusion for external, real sounds than closed earphones. However, a drawback of these techniques is that the low acoustic impedance seal can still distort the acoustic filtering of the outer ear. Therefore, earphones that allow for delivering both real audio as well as electronically produced, undistorted audio are widely desired.

SUMMARY

An example headphone arrangement includes at least one earphone. The at least one earphone includes a sealed housing having an aperture and a tube with a longitudinal axis. The tube is curved along its longitudinal axis to form a closed or open ring configured to totally or partly surround an ear of a user. A speaker is mounted to the housing at the aperture so that the housing in connection with the speaker encloses a closed acoustic volume.

Other systems, methods, features and advantages will be, or will become, apparent to one with skill in the art upon examination of the following detailed description and appended figures. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
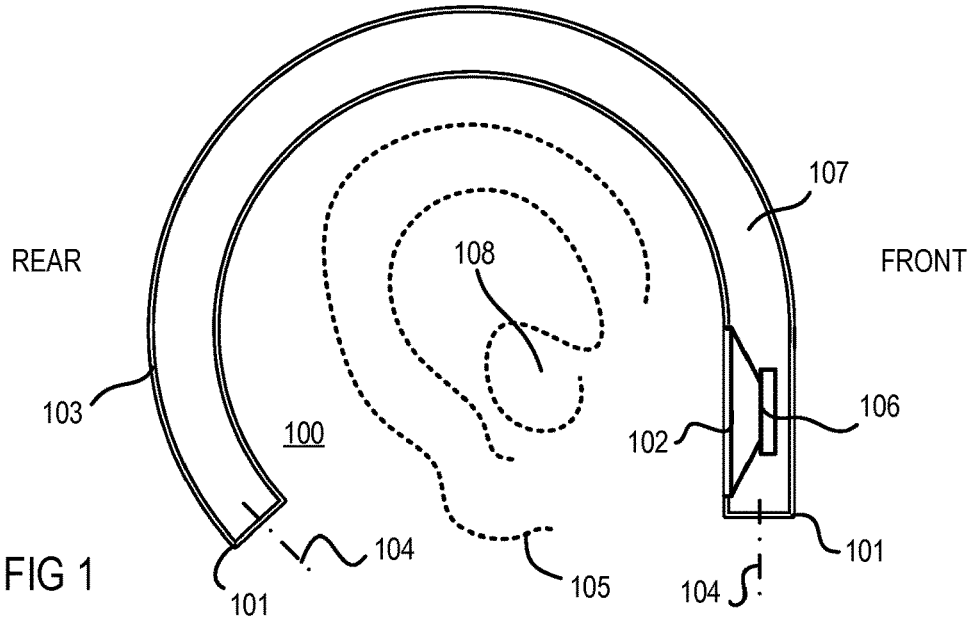
FIG. 1 is a schematic cross-sectional side view of an exemplary earphone with one speaker disposed in an aperture of a sealed tube that is curved to form an open ring.

FIG. 1 is a schematic cross-sectional side view of an exemplary earphone 100 which includes a sealed hollow housing 101 with an aperture 102. The housing 101 includes a tube 103 which has a longitudinal axis 104 and which is curved along its longitudinal axis 104 to form an open ring configured to partly surround a user's ear 105. The tube 101 may include the aperture 102 as shown. A broadband speaker 106 (e.g., operable in the frequency range 20 Hz-20 kHz) is mounted to the housing 101 at the aperture 102 so that the housing 103 together with the speaker 106 encloses a closed acoustic volume 107. The position of the speaker 106 may be such that the speaker 106 radiates from the direction that is identified as front side (face) by the user to the ear 105, e.g., to a concha 108 of the ear 105. The cross-section (not shown) of the tube 103 may have an oval (e.g., circular), rectangular, (e.g., quadratic), trapezoid, polyhedral or any other appropriate shape. The shape of the open ring formed by the curved tube 103 and optionally by additional parts of the housing 101 may have an oval (e.g., circular as shown), rectangular, (e.g., quadratic), trapezoid, polyhedral or any other appropriate shape. The enclosed acoustic volume 107 may be filled with damping material (not shown) such as foam, expanded plastic, rock wool, or any other appropriate material. The sealed hollow housing 101 may further include one or more vents or ports (not shown) if appropriate.

Figure 2:
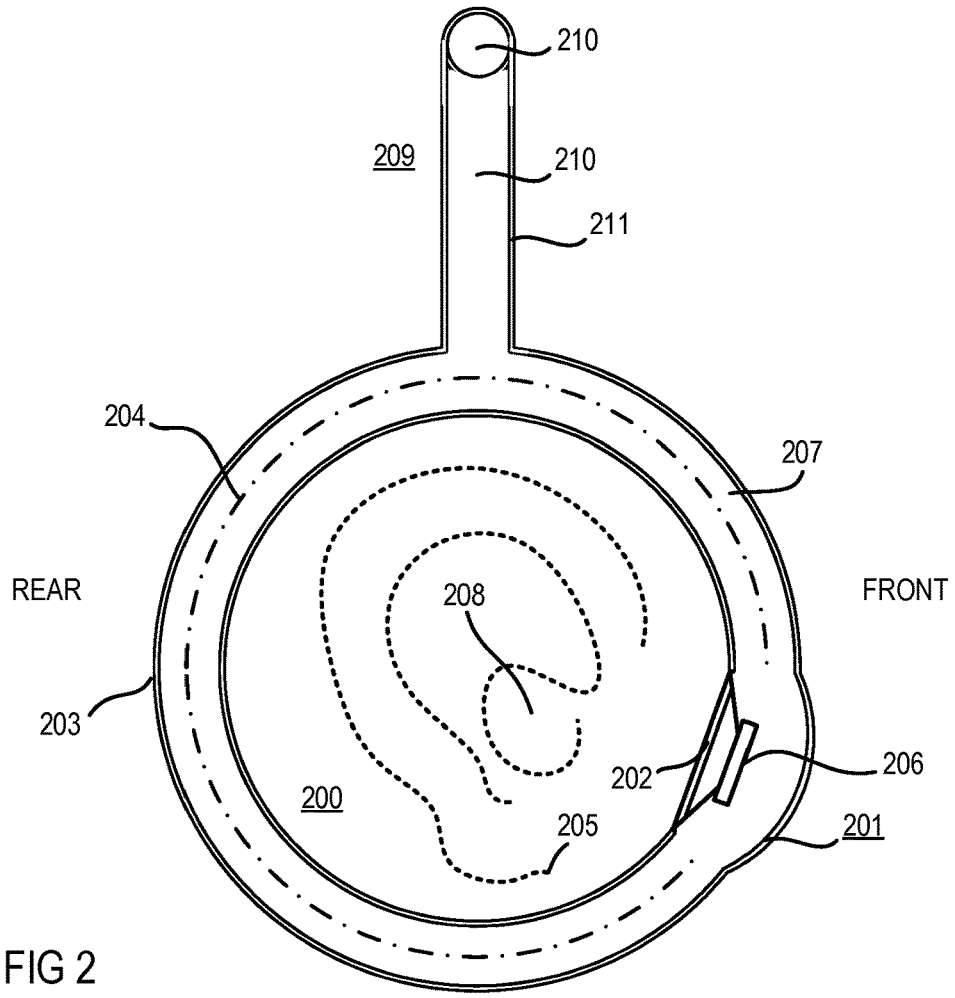
FIG. 2 is a schematic cross-sectional side view of an exemplary earphone with one speaker disposed in an aperture of a sealed tube that is curved to form a closed ring.

FIG. 2 is a schematic cross-sectional side view of an exemplary earphone 200 which includes a sealed hollow housing 201 with an aperture 202. The housing 201 includes a tube 203 which has a longitudinal axis 204 and is curved along its longitudinal axis 204 to form a closed ring configured to completely surround a user's ear 205. The tube 201 may include the aperture 202 as shown. A broadband speaker 206 (e.g., operable in the frequency range 10 Hz-22 kHz) is mounted to the housing 201 at the aperture 202 so that the housing 203 together with the speaker 206 encloses a closed acoustic volume 207. The position of the speaker 206 may be such that the speaker 206 radiates from the direction that is identified as lower front side by the user to the ear 205, e.g., to a concha 208 of the ear 205. The cross-section (not shown) of the tube 203 may have an oval (e.g., circular), rectangular, (e.g., quadratic), trapezoid, polyhedral or any other appropriate shape. The shape of the closed ring formed by the curved tube 203 and optionally by additional parts of the housing 201 may have an oval (e.g., circular as shown), rectangular, (e.g., quadratic), trapezoid, polyhedral or any other appropriate shape. The enclosed acoustic volume 207 may be filled with damping material (not shown) such as foam, expanded plastic, rock wool, or any other appropriate material. The sealed hollow housing 201 may further include one or more vents or ports (not shown) if appropriate.

Figure 3:
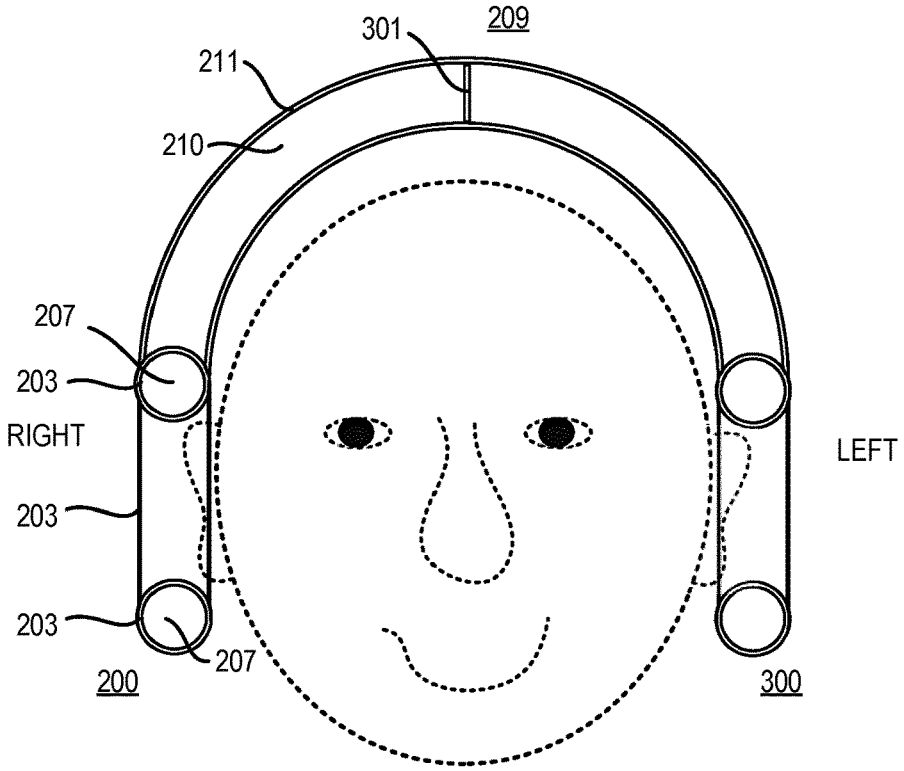
FIG. 3 is a schematic cross-sectional front view of the earphone shown in FIG. 2.

Furthermore, the earphone 200, e.g., its tube 203, may be attached to a headband 209 which may provide another acoustic volume 210. The acoustic volume 210 may be acoustically coupled to the acoustic volume 207 so that the resulting acoustic volume is larger than each of the two separate volumes. For this, headband 209 may include another tube 211 which is movably or rigidly attached to the tube 203 in a manner so that the acoustic volume 210 and the acoustic volume 207 are acoustically coupled with each other. A schematic cross-sectional front view of the earphone 200 with the attached headband 209 is shown in FIG. 3. In this example, the earphone 200 is attached to the headband 209 at one end and another earphone 300, which is similar or identical to earphone 200, is attached to the other end of headband 209. The earphone 300 has, as earphone 200 does, an acoustic volume that is acoustically coupled to the acoustic volume 210 of the headband 209. Optionally, the headband 209 may have a divider 301 that divides the acoustic volume of (the tube 211 of) the headband 209 into two separate partial volumes which are acoustically isolated from each other. One of the partial volumes is acoustically coupled to the volume of earphone 200 and the other to the volume of earphone 300.

Figure 4:
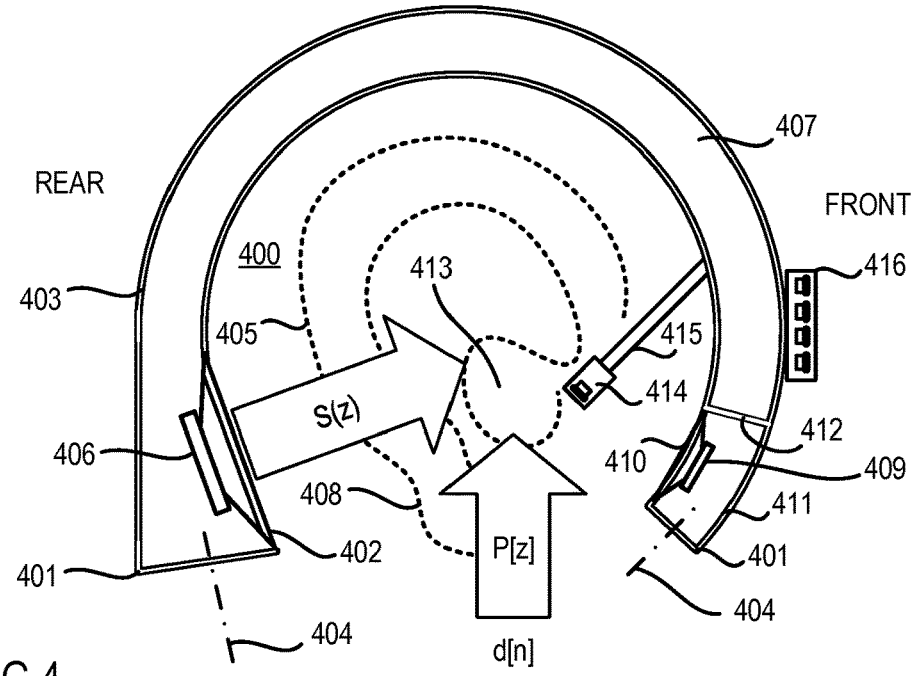
FIG. 4 is a schematic cross-sectional side view of an exemplary earphone with two speakers disposed in two apertures of a sealed tube that is curved to form an open ring.

FIG. 4 is a schematic cross-sectional side view of an exemplary earphone 400 which includes a sealed hollow housing 401 with an aperture 402. The housing 201 includes a tube 203 which has a longitudinal axis 404 and is curved along its longitudinal axis 404 to form an open ring configured to partly surround a user's ear 405. The tube 401 may include the aperture 402 as shown. A lower frequency speaker 406 (for a lower frequency range at and below, e.g., 200 Hz, 500 Hz or 1000 Hz) is mounted to the housing 401 at the aperture 402 so that the housing 403 together with the speaker 406 encloses a closed acoustic volume 407. The position of the speaker 406 may be such that the speaker 406 radiates from the direction that is identified as rear side (occipital) by the user to the ear 405, e.g., an anti-tragus 408 of the ear 405. The cross-section (not shown) of the tube 403 may have an oval (e.g., circular), rectangular, (e.g., quadratic), trapezoid, polyhedral or any other appropriate shape. The shape of the open ring formed by the curved tube 403 and optionally by additional parts of the housing 401 may have an oval (e.g., circular or circular as shown), rectangular, (e.g., quadratic), trapezoid, polyhedral or any other appropriate shape. The enclosed acoustic volume 407 may be filled with damping material (not shown) such as foam, expanded plastic, rock wool, or any other appropriate material. The sealed hollow housing 401 may further include one or more vents or ports (not shown) if appropriate.

Further, the earphone 400 depicted in FIG. 4 includes a higher frequency speaker 409 (for a lower frequency range at and above, e.g., 200 Hz, 500 Hz or 1000 Hz). The speaker 409 is mounted in another aperture 410 of the tube 403 and is acoustically coupled to another acoustic volume 411 which is provided by a section that is acoustically separated from the acoustic volume 407 by a hermetically sealing divider 412. The position of the speaker 406 may be such that the speaker 406 radiates from the direction that is identified as front side (face) by the user to the ear 405, e.g., a concha 413 of the ear 405. Optionally, a microphone 414 attached via a stick-like carrier 415 to the tube 403 may be disposed close to the concha 413 and directed thereto. The microphone 414 may be employed, for example, in connection with an active noise control (ANC) system. Optionally, a microphone array 416 (including a multiplicity of individual microphones) may be attached to the tube 403 at a position close to the concha 413 and directed to the front side in order to pick up sound that includes from the front side.

The earphones described above in connection with FIGS. 1-4 have the distinction of essentially placing no acoustic barrier between a real sound source and the user's ear as the inner area of the ring is open. Therefore, sound from the real sound source is essentially not distorted by the earphone. Simultaneously, electronically produced audio can be reproduced by way of the speaker(s) of the earphone so that the two sounds are acoustically mixed. However, in some situations it might be desirable to only hear the electronically produced audio instead of both sounds together. In the examples described below in connection with FIGS. 5 and 6, an ANC system, if active, is used to cancel out the sound from the real sound source. This means that if the ANC system is active, the earphone behaves like a closed earphone, and, if the ANC system is not active, like a completely open earphone or no earphone at all.

Figure 5:
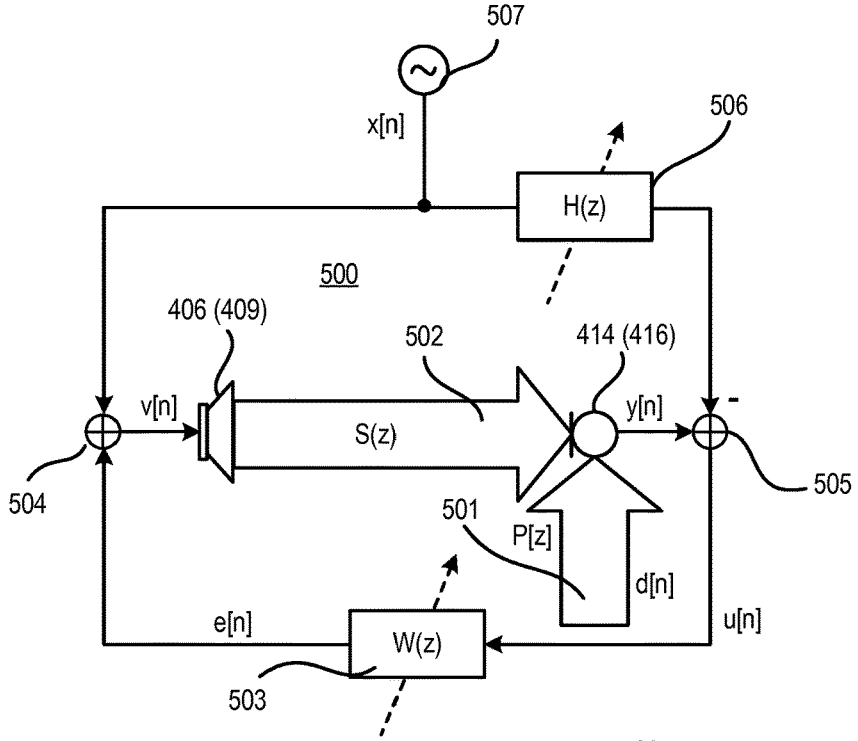
FIG. 5 is a signal flow diagram of an exemplary active noise control processor applicable in or in connection with the earphone shown in FIG. 3.

Referring to FIG. 5, in a feedback type ANC processor 500, which may be used to form a feedback structure or part of a combined feedforward/feedback structure to be applied in the arrangement shown in FIG. 3, real sound d[n] is radiated to the user's ear 405 via a primary path 501. The primary path 501 has a transfer characteristic of P(z). Additionally, an output signal v[n] is transformed into sound and radiated by a loudspeaker, such as loudspeaker 406 (or 409), to the listening site via a secondary path 502. The secondary path 502 has a transfer characteristic of S(z). A microphone, such as microphone 414 shown in FIG. 4, is positioned at the listening site and receives sound that arises from the loudspeaker 406 (or 409) and the real sound d[n]. The microphone 414 provides a microphone output signal y[n] that represents the sum of these received sounds. The microphone output signal y[n] is supplied as filter input signal u[n] to a feedback ANC filter 503 that outputs to an adder 504 an error signal e[n].

The ANC filter 503, which may be an adaptive filter, has a transfer characteristic of W(z). The adder 504 also receives an input signal x[n], which represents an electronically produced audio signal such as a music or speech signal stored in an electronic memory, and provides the output signal v[n] to the loudspeaker 406 (or 409). Further, a subtractor 505 subtracts the input signal x[n] from the microphone output signal y[n] to form the feedback ANC filter input signal u[n]. Optionally, the input signal x[n] may be injected into the feedback loop either via adder 504 or subtractor 505 or, as shown, via both adder 504 and subtractor 505. Optionally, the input signal x[n] may be filtered by an additional filter 506 with a transfer function H(z), e.g., a transfer function modelling the transfer function S(z) or a low-pass filter characteristic, before it is supplied to subtractor 505.

Signals X(z), Y(z), V(z), E(z) and U(z) represent in the spectral domain (z-domain) the (discrete) time domain signals x[n], y[n], v[n], e[n] and u[n], so that the differential equations describing the system illustrated in FIG. 5 are as follows:

$$Y(z)=S(z)\cdot V(z)=S(z)\cdot(E(z)+X(z)),$$

$$E(z)=W(z)\cdot U(z)=W(z)\cdot(Y(z)-H(z)\cdot X(z)),\text{ and assuming that } H(z)\approx S(z)\text{ then}$$

$$E(z)=W(z)\cdot U(z)\approx W(z)\cdot(Y(z)-S(z)\cdot X(z)).$$

Figure 6:
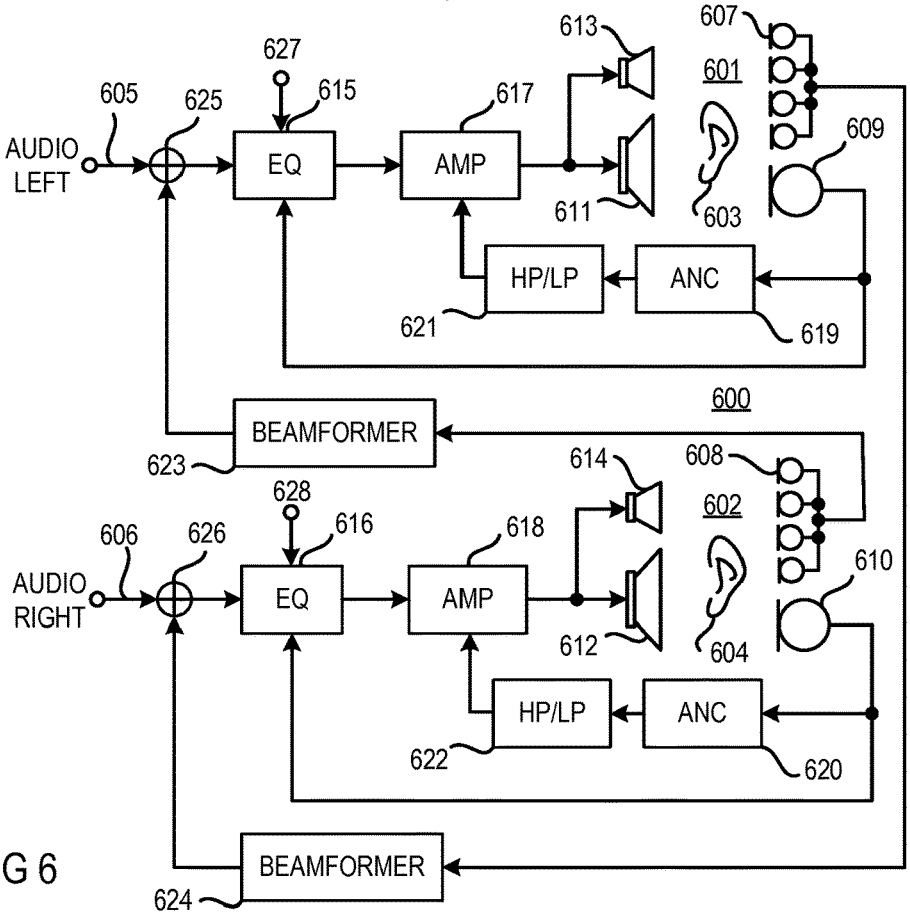
FIG. 6 is a signal flow diagram of an exemplary active noise control processor applicable in the earphone shown in FIG. 3 using a microphone array with beamforming functionality.

Referring to FIG. 6, a headphone arrangement 600 includes two identical earphones 601 and 602 (e.g., each similar to the earphone 400 show in FIG. 4) placed over a user's left ear 603 and a user's right ear 604, respectively, and adequate control circuitry for the earphones 601 and 602. In the control circuitry, a left audio input 605 is provided to the user's left ear 603 and a right audio input 606 is provided to the user's right ear 604. The left earphone 601 includes an array 607 of (e.g., four) microphones such as the array 416 shown in FIG. 4 and multiple (e.g., two) speakers 611, 613 such as loudspeakers 406 and 409 shown in FIG. 4. Likewise, the left headphone 601 includes a microphone 609 such as microphone 413 shown in FIG. 4. The right earphone 602 includes an array 608 of (e.g., four) microphones such as the array 416 shown in FIG. 4 and multiple (e.g., two) speakers 612, 614 such as loudspeakers 406 and 409 shown in FIG. 4. Likewise, the left headphone 602 includes a microphone 610 such as microphone 413 shown in FIG. 4.

The left earphone 601 includes or is connected to the control circuitry, which may include a controllable equalizing block 615, an amplifier block 617, an ANC filter 619, a highpass/lowpass filter block 621, and a beamforming block 623. The right earphone 602 includes or is connected to a controllable equalizing block 616, an amplifier block 618, an ANC filter 620, a highpass/lowpass filter block 622, and a beamforming block 624. In operation, the left audio input 605 is provided to the equalizing block 56 to equalize, i.e., to adjust the balance between frequency components within the left audio input 605. The amplifier block 617 amplifies the equalized left audio input 605 and provides the same to the speakers 611 and 613. The speaker 613 provides the main (higher frequency) audio portion of the amplified equalized left audio input 605 to the user's left ear 603. Conversely, the speaker 611 provides a bass (lower frequency) portion of the amplified equalized left audio input 605 to the user's left ear 603.

The microphone 609 picks up sound which is converted into an electrical signal and then transmitted via the ANC filter 619 and the filter block 621 to the amplifier block 617. The microphone 609 may also transmit its electrical signal to the equalizing block 615. Similarly, the microphone 610 picks up sound which is converted into an electrical signal and then transmitted via the ANC filter 620 and the filter block 622 to the amplifier block 618. The microphone 610 may also transmit its electrical signal to the equalizing block 616. The array 607 of microphones may also pick up or receive sound at the user's left ear 603 which is converted into an electrical signal and then transmitted to the beamforming block 624 (which corresponds to earphone 602). Conversely, array 608 of microphones may also pick up or receive sound at the user's right ear 604 which is converted into an electrical signal and then transmitted to the beamforming block 623 (which corresponds to earphone 602). The blocks corresponding to earphone 604 operate in a similar manner as the blocks discussed above in connection with the earphone 601.

Optionally, the amplifying blocks 617 and 618 may include a limiter or compressor function to avoid excessive loudness at the user's ears. Further, the beamforming blocks 623 and 624 may be used for (mono-) beamforming to the front side and cross-coupling between left and right audio channels so that feedback can be avoided. Optionally, the beamforming blocks 623 and 624 in connection with the arrays 607 and 608 of microphones may be used for picking up (stereo) sound originating from a frontal direction and for processing the picked-up sound in order to magnify the sound impression in front of the user by reproducing, via speakers disposed in front of the ears (e.g., speakers 613 and 614), amplified sound originating from this frontal direction. The equalizing blocks 615 and 616 in connection with the corresponding microphones 609 and 610 may form an automatic (stereo) equalizer that adjusts the sound provided by the loudspeakers 611-614 at the microphones 609 and 610 to a target sound 627 and 628. The automatic equalizer may supply the loudspeakers 611-614 of each earphone 601 and 602 with the respective electrical sound signal, may continuously or sequentially assess the deviation of the acoustical sound provided by the loudspeakers 611-614 from the target sound 627 and 628, and may adjust the loudspeakers to a relatively small, e.g., minimum deviation from the target sound 627 and 628 by equalizing the electrical signals supplied to the loudspeakers 611-614. The filter blocks 621 and 622 may have transfer functions that allow for restricting the frequency range in which the ANC functionality is active. As the case may be, the filter blocks 621 and 622 may form part of the ANC filter or may be even the ANC filter.

In general, on ear, over ear and in ear headphones may have a tendency to cause pain to or irritate a user's ears. This may be particularly prevalent in cases where the headphones are positioned over a user's ears for long periods of time and/or when the user sweats during exercise while wearing the headphones. Ambient sound may sound artificial with these types of headphones. The headphone arrangements disclosed herein can provide a true environmental awareness which in essence is like not wearing any type of headphones at all during audio playback. The headphone arrangements may incorporate active noise control without passive attenuation to cancel out ambient sound so that no sound barrier is close to or in the ear canal. The active noise control may have a constant and variable gain active noise control damping without any change in the frequency characteristic of the electronically produced audio signal. The headphone arrangements may utilize at least one microphone for "true note" equalization in order to provide a higher degree of sound fidelity (e.g., linearization) and personalization (e.g., personal target function) at the user's ears, and, given that higher frequencies are provided in front of the ears, provide improved out-of-head localization. The headphone arrangements may include magnifying the sound in front of the user by reproducing, via speakers disposed in front of the ears, amplified sound originating from a frontal direction. Optionally, a limiting or compressing function may be employed in the electronic sound path to prevent the audible sound from becoming too loud. Further, (mono-) beamforming to the front side may be employed to avoid feedback by cross-wise coupling of beamfomer blocks between microphones and loudspeakers of two earphones.

Parts or all of the control circuitry may be implemented as software and/or firmware executed by processor or programmable digital circuit. It is recognized that any control circuit as disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any control circuit as disclosed utilizes any one or more microprocessors to execute a computer-program that is embodied in a non-transitory computer readable medium that is programmed to perform any number of the functions as disclosed.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature, and may include additional elements and/or omit elements.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

While various embodiments of the invention have been described, it will be apparent to those of ordinary skilled in the art that many more embodiments and implementations are possible within the scope of the invention. In particular, the skilled person will recognize the interchangeability of various features from different embodiments. Although these techniques and systems have been disclosed in the context of certain embodiments and examples, it will be understood that these techniques and systems may be extended beyond the specifically disclosed embodiments to other embodiments and/or uses and obvious modifications thereof.

The invention claimed is:

1. A headphone arrangement comprising at least one earphone, the at least one earphone comprising:

a sealed housing comprising an aperture and a tube with a longitudinal axis, the tube being curved along a longitudinal axis thereof to form a closed or open ring configured to totally or partly surround an ear of a user;

a loudspeaker mounted to the housing at the aperture so that the housing in connection with the loudspeaker encloses a closed acoustic volume; and an additional loudspeaker, wherein:

the loudspeaker mounted in the aperture is a lower frequency loudspeaker and the additional loudspeaker is a higher frequency loudspeaker;

the additional loudspeaker has a frequency that is higher than a highest frequency of the loudspeaker and is disposed in the tube at a position corresponding to a front side of the ear of the user; and the loudspeaker has a frequency that is lower than a lowest frequency of the additional loudspeaker and is disposed in the tube at a position corresponding to a side of the ear of the user other than the front side.

2. The arrangement of claim 1, further comprising a headband movably or rigidly connected to the housing, the headband enclosing another acoustic volume, the another acoustic volume of the headband being acoustically coupled to the closed acoustic volume of the tube.

3. The arrangement of claim 1, wherein the additional loudspeaker is acoustically isolated from the acoustic volume.

4. The arrangement of claim 1, further comprising an active noise cancellation system that is electrically connected at least to the loudspeaker mounted in the aperture, the active noise cancellation system being configured to reduce ambient sound originating from outside the housing at the ear of the user.

5. The arrangement of claim 4, wherein the active noise cancellation system comprises a microphone, the microphone being attached to the housing and disposed in a position close to a concha of the ear of the user.

6. The arrangement of claim 1, further comprising a controllable equalizer connected upstream of the earphone.

7. The arrangement of claim 6, wherein the equalizer is configured to be controlled in accordance with sound picked in a position close to a concha of the ear of the user and a target function.

8. The arrangement of claim 1, further comprising an array of microphones and a beamforming system, the array of microphones being attached to the housing, and the array of microphones and the beamforming system having in combination a directivity characteristic that is controllable via the beamforming system.

9. The arrangement of claim 8, wherein the directivity characteristic of the array of microphones and the beamforming system in combination is controllable to have a maximum directivity to a front side of the ear of the user.

10. The arrangement of claim 9, further comprising an additional earphone configured to totally or partly surround another ear of the user, an additional array of microphones, and an additional beamforming system.

11. The arrangement of claim 10, wherein the array of microphones, the additional array of microphones, the beamforming system and the additional beamforming system are configured to generate beamformer signals representing sound arising from the front side, the beamformer signals being used to magnify the sound arising from the front side at the ear of the user.

12. The arrangement of claim 10, wherein the array of microphones, the additional array of microphones, the beamforming system and the additional beamforming system are configured to generate beamformer signals representing sound arising from the front side, the beamformer signals supplied crosswise to the additional earphone and the earphone.

13. A headphone arrangement comprising at least one earphone, the at least one earphone comprising:

a sealed housing comprising an aperture and a tube being curved along an axis to form a closed ring configured to totally or partly surround an ear of a user;

a loudspeaker mounted to the housing at the aperture so that the housing in connection with the loudspeaker encloses a closed acoustic volume; and an additional loudspeaker, wherein:

the loudspeaker mounted in the aperture is a lower frequency loudspeaker and the additional loudspeaker is a higher frequency loudspeaker;

the additional loudspeaker has a frequency that is higher than a highest frequency of the loudspeaker and is disposed in the tube at a position corresponding to a front side of the ear of the user; and the loudspeaker has a frequency that is lower than a lowest frequency of the additional loudspeaker and is disposed in the tube at a position corresponding to a side of the ear of the user other than the front side.

14. The arrangement of claim 13 further comprising a headband movably or rigidly connected to the housing, the headband enclosing another acoustic volume, the acoustic volume of the headband being acoustically coupled to the acoustic volume of the tube.

15. The arrangement of claim 13, wherein the additional loudspeaker is acoustically isolated from the acoustic volume.

16. The arrangement of claim 13 further comprising an active noise cancellation system that is electrically connected at least to the loudspeaker mounted in the aperture, the active noise cancellation system being configured to reduce ambient sound originating from outside the housing at the ear of the user.

17. The arrangement of claim 16, wherein the active noise cancellation system comprises a microphone being attached to the housing and disposed in a position close to a concha of the ear of the user.

18. A headphone arrangement comprising at least one earphone, the at least one earphone comprising:

a sealed housing comprising an aperture and a tube being curved along an axis to form an open ring configured to totally or partly surround an ear of a user;

a loudspeaker mounted to the housing at the aperture so that the housing in connection with the loudspeaker encloses a closed acoustic volume; and an additional loudspeaker, wherein:

the loudspeaker mounted in the aperture is a lower frequency loudspeaker and the additional loudspeaker is a higher frequency loudspeaker;

the additional loudspeaker has a frequency that is higher than a highest frequency of the loudspeaker and is disposed in the tube at a position corresponding to a front side of the ear of the user; and the loudspeaker has a lowest frequency that is lower than a lowest frequency of the additional loudspeaker and is disposed in the tube at a position corresponding to a side of the ear of the user other than the front side.

19. A headphone arrangement comprising at least one earphone, the at least one earphone comprising:

a sealed housing comprising an aperture and a tube with a longitudinal axis, the tube being curved along a longitudinal axis thereof to form a closed or open ring configured to totally or partly surround an ear of a user;

a loudspeaker mounted to the housing at the aperture so that the housing in connection with the loudspeaker encloses a closed acoustic volume; and an active noise cancellation system that is electrically connected at least to the loudspeaker mounted in the aperture, the active noise cancellation system being configured to reduce ambient sound originating from outside the housing at the ear of the user.

20. A headphone arrangement comprising at least one earphone, the at least one earphone comprising:

a sealed housing comprising an aperture and a tube with a longitudinal axis, the tube being curved along a longitudinal axis thereof to form a closed or open ring configured to totally or partly surround an ear of a user;

a loudspeaker mounted to the housing at the aperture so that the housing in connection with the loudspeaker encloses a closed acoustic volume; and an array of microphones and a beamforming system, the array of microphones being attached to the housing, and the array of microphones and the beamforming system having in combination a directivity characteristic that is controllable via the beamforming system.

21. A headphone arrangement comprising at least one earphone, the at least one earphone comprising:

a sealed housing comprising an aperture and a tube being curved along an axis to form a closed ring configured to totally or partly surround an ear of a user;

a loudspeaker mounted to the housing at the aperture so that the housing in connection with the loudspeaker encloses a closed acoustic volume; and an active noise cancellation system that is electrically connected at least to the loudspeaker mounted in the aperture, the active noise cancellation system being configured to reduce ambient sound originating from outside the housing at the ear of the user.

22. A headphone arrangement comprising at least one earphone, the at least one earphone comprising:

a sealed housing comprising an aperture and a tube being curved along an axis to form a closed ring configured to totally or partly surround an ear of a user;

a loudspeaker mounted to the housing at the aperture so that the housing in connection with the loudspeaker encloses a closed acoustic volume; and an array of microphones and a beamforming system, the array of microphones being attached to the housing, and the array of microphones and the beamforming system having in combination a directivity characteristic that is controllable via the beamforming system.

23. A headphone arrangement comprising at least one earphone, the at least one earphone comprising:

a sealed housing comprising an aperture and a tube being curved along an axis to form an open ring configured to totally or partly surround an ear of a user;

a loudspeaker mounted to the housing at the aperture so that the housing in connection with the loudspeaker encloses a closed acoustic volume; and an active noise cancellation system that is electrically connected at least to the loudspeaker mounted in the aperture, the active noise cancellation system being configured to reduce ambient sound originating from outside the housing at the ear of the user.

24. A headphone arrangement comprising at least one earphone, the at least one earphone comprising:

a sealed housing comprising an aperture and a tube being curved along an axis to form an open ring configured to totally or partly surround an ear of a user;

a loudspeaker mounted to the housing at the aperture so that the housing in connection with the loudspeaker encloses a closed acoustic volume; and an array of microphones and a beamforming system, the array of microphones being attached to the housing, and the array of microphones and the beamforming system having in combination a directivity characteristic that is controllable via the beamforming system.

* * * * *